US007794851B2

(12) United States Patent
Vichniakov

(10) Patent No.: US 7,794,851 B2
(45) **Date of Patent: *Sep. 14, 2010**

(54) FIBER-REINFORCED METALLIC COMPOSITE MATERIAL AND METHOD

(75) Inventor: Alexei Vichniakov, Buzbehude (DE)

(73) Assignee: Airbus Deutschland GmbH, Hamburg (DE)

( * ) Notice: Subject to any disclaimer, the term of this patent is extended or adjusted under 35 U.S.C. 154(b) by 843 days.

This patent is subject to a terminal disclaimer.

(21) Appl. No.: 11/018,583

(22) Filed: Dec. 20, 2004

(65) Prior Publication Data

US 2005/0136256 A1 Jun. 23, 2005

(30) Foreign Application Priority Data

Dec. 19, 2003 (DE) ..... 103 60 808

(51) Int. Cl.
*B32B 15/14* (2006.01)
*B32B 3/06* (2006.01)
*B32B 5/10* (2006.01)
*C22C 49/14* (2006.01)

(52) U.S. Cl. ..... 428/555; 428/549; 428/614; 428/621; 427/180; 427/191; 427/287; 427/375; 427/383.1

(58) Field of Classification Search ..... None
See application file for complete search history.

(56) References Cited

U.S. PATENT DOCUMENTS 4,411,380 A 10/1983 McWithey et al.
4,489,123 A 12/1984 Schijve et al.
4,500,589 A 2/1985 Schijve et al.
4,615,733 A 10/1986 Kubo et al.
5,403,653 A * 4/1995 Moreton et al. ..... 428/300.4
5,426,000 A * 6/1995 Labib et al. ..... 428/547
5,539,040 A 7/1996 Rohrmann
5,660,923 A * 8/1997 Bieler et al. ..... 442/377
6,114,050 A 9/2000 Westre et al.
6,595,467 B2 7/2003 Schmidt
6,647,747 B1 11/2003 Brik
6,712,315 B2 3/2004 Schmidt et al.
7,001,857 B2 2/2006 Degroote
7,045,210 B2 5/2006 Bleibler
7,100,871 B2 9/2006 Assler et al.

(Continued)

FOREIGN PATENT DOCUMENTS

DE 41 16 639 11/1992

(Continued)

*Primary Examiner*—Jennifer C McNeil
*Assistant Examiner*—Jason L Savage
(74) *Attorney, Agent, or Firm*—W. F. Fasse; W. G. Fasse

(57) ABSTRACT

A fiber composite material which is particularly suitable for aircraft construction, includes inorganic mineral fibers embedded or enclosed in a metal matrix. The mineral fibers include a substantial or dominant proportion of $SiO_2$, and/or $Al_2O_3$ and/or $Fe_2O_3$, the remainder being rock material. The fibers have a length of at least 10 mm and are oriented in parallel to one another in at least one direction. The metal matrix is made of aluminum, aluminum alloys, magnesium, magnesium alloys, titanium or titanium alloys. These matrix metal alloys contain a substantial or dominant proportion of the respective metal. The fibers are preferably coated with particles of the matrix metal and bonded to one another to form fiber films or fiber sheets which are then laminated between sheets of matrix metal.

23 Claims, 4 Drawing Sheets

U.S. PATENT DOCUMENTS

| | | | | |
|---|---|---|---|---|
| 2002/0086165 | A1* | 7/2002 | Davis et al. | 428/446 |
| 2005/0112347 | A1 | 5/2005 | Schmidt et al. | |
| 2005/0112348 | A1 | 5/2005 | Schmidt et al. | |
| 2005/0191510 | A1* | 9/2005 | Gordon et al. | 428/611 |
| 2005/0233125 | A1* | 10/2005 | Anderson et al. | 428/221 |
| 2005/0238868 | A1* | 10/2005 | Joseph et al. | 428/319.1 |
| 2006/0060325 | A1* | 3/2006 | Gordon et al. | 164/98 |
| 2006/0147690 | A1* | 7/2006 | Vichniakov et al. | 428/292.1 |

FOREIGN PATENT DOCUMENTS

| | | |
|---|---|---|
| EP | 0 056 288 | 7/1982 |
| EP | 0 181 996 | 5/1986 |
| EP | 0 312 151 | 4/1989 |
| EP | 0 573 507 | 12/1993 |
| EP | 0 783 960 | 7/1997 |
| RU | 2 182 605 | 5/2002 |
| WO | WO92/15453 | 9/1992 |

* cited by examiner

FIBER-REINFORCED METALLIC COMPOSITE MATERIAL AND METHOD

PRIORITY CLAIM

This application is based on and claims the priority under 35 U.S.C. §119 of German Patent Application 103 60 808.7, filed on Dec. 19, 2003, the entire disclosure of which is incorporated herein by reference.

FIELD OF THE INVENTION

The invention relates to fiber-reinforced composite materials, particularly materials with mineral fibers embedded in a metal matrix. Such composite materials are formed by a method as disclosed herein.

BACKGROUND INFORMATION

It is known to use relatively long mineral fibers in thermal insulating materials in the construction industry. Primarily basaltic fibers are used for thermal insulating purposes or for reinforcing of concrete products. Such basaltic relatively long fibers are also known to be used for making support plates or substrates for electronic components.

European Patent Publication EP 0,181,996 A2, U.S. Pat. No. 4,615,733, and Russian Patent Publication RU 2,182,605 C1 disclose the use of fiber-reinforced composite materials with a metal matrix. The fibers embedded in the matrix are short and distributed at random. Thus, the orientation of the short fibers relative to each other is also random. The conventionally used short fibers are generally made of a mineral material with substantial proportions of silicon oxide ($SiO_2$), aluminum oxide ($Al_2O_3$), and iron oxide ($Fe_2O_3$). However, conventional fiber-reinforced composite materials with short fibers in a metal matrix do not have the mechanical characteristics required, for example in aircraft construction. Such mechanical characteristics include, for example a substantial tolerance relative to damages, particularly a toughness against crack formations and a resistance against fatigue effects, such as fatigue crack propagation.

In the construction of lightweight structural components emphasis is always on the weight reduction, particularly in the aircraft industry. Moreover, and depending on the respective field of application, such composite materials must meet different requirements with regard to their static and dynamic fatigue characteristics including their tolerance to damages. This requirement applies, particularly in the aircraft construction where lightweight structural components must tolerate damages to avoid failure of the aircraft. An improvement of these damage tolerance characteristics can be achieved in different ways, for example by increasing the skin thickness of an aircraft body or body component. The use of additional locally distributed stiffening components helps increasing the damage tolerance. Adapting the skin thickness in those local positions where stress is largest helps improving the damage tolerance. However, all these measures do not necessarily satisfy weight limitations. Hence, there is a need for a compromise, which particularly in the aircraft industry, is not readily acceptable. Another possibility of increasing the damage tolerance characteristics of such composite materials is the use of materials having inherently better damage tolerance characteristics. Materials having such characteristics are metallic laminates or fiber-reinforced laminates.

Recently, fiber-reinforced composite materials with a metal matrix are achieving an increasing significance because in such materials the fibers permit increasing the strength of metallic materials. More specifically, the damage tolerance characteristics of metallic materials can be significantly increased by reinforcing fibers. However, such an improvement is achieved with noticeably higher costs for such metal based fiber composite materials. One important reason for the higher costs lies in the higher production costs. Particularly, production methods in which the metal matrix is melted onto the fibers, involve a substantial effort and expense with regard to production times and production costs. Such costs have been reduced in a relatively economical production method in which sheet metal layers are bonded to each other by an intermediate adhesive film containing the reinforcing fibers.

In this connection reference is made to European Patent Publication EP 0,312,151 disclosing a laminate comprising at least two sheet metal layers with a synthetic adhesive layer between the sheet metal layers, whereby the adhesive layer bonds the sheet metal layers to each other. The adhesive bonding layer comprises glass filaments. Such laminates are particularly useful for lightweight construction in the aircraft industry because these laminates have advantageous mechanical characteristics while simultaneously having a low structural weight.

European Patent Publication EP 0,056,288 discloses a metal laminate in which polymer fibers are used in the bonding layer. These fibers are selected from the group of aramides, polyaromatic hydrazins, and aromatic polyesters in a synthetic material layer.

European Patent Publication EP 0,573,507 discloses a laminated material in which reinforcing fibers are embedded in a synthetic material matrix. The reinforcing fibers used in EP 0,573,507 are selected from a group of carbon fibers, polyaromatic amide fibers, aluminum oxide fibers, silicon carbide fibers, or mixtures of these components.

The above described sheet metal laminates, if compared with equivalent monolithic sheet metals have the advantages of noticeably higher damage tolerance characteristics. For example, metal laminates reinforced with long fiber bonding layers have crack propagation characteristics that are smaller by a factor of 10 to 20 as compared to respective crack propagation characteristics of monolithic sheet metals. On the other hand, these known laminated materials have frequently static characteristics that are worse than those of monolithic materials. For example, the elastic fatigue limits relative to a tension load or pressure load or a shearing load, are lower by about 5 to 20% compared to respective characteristics of equivalent monolithic materials. The fatigue limits of these known laminated materials depend on the use of the type of the bonding or adhesive system and on the types of fibers used in the system.

Efforts to improve the static characteristics of conventional fiber-composite materials are burdened by higher costs. Conventional manufacturing methods, such as powder metallurgical methods or embedding of fibers in a melted matrix material are very cost sensitive. Moreover, the size of conventional fiber-reinforced composite materials producible by the just-mentioned two methods, are rather limited.

OBJECTS OF THE INVENTION

In view of the foregoing it is an aim of the invention to achieve the following objects singly or in combination:

- to substantially improve the static characteristics of fiber reinforced composite materials having a metal matrix;
- more specifically to improve the damage tolerance characteristics while simultaneously achieving a substantial cost reduction compared to conventional production methods of such materials for the same use in the aircraft industry;

to improve the toughness against cracks and the resistance against crack propagation including fatigue crack propagation.

The invention further aims to avoid or overcome the disadvantages of the prior art, and to achieve additional advantages, as apparent from the present specification. The attainment of these objects is, however, not a required limitation of the claimed invention.

SUMMARY OF THE INVENTION

The above objects have been achieved according to the invention by the combination of the following features in a fiber composite material comprising a matrix made of a metal selected from a first group comprising aluminum, aluminum alloys, magnesium, magnesium alloys, titanium or titanium alloys, or mixtures thereof. The respective alloys comprise the aluminum or the magnesium or the titanium as a dominant component. Reinforcing inorganic fibers are embedded or enclosed in the metal matrix. The reinforcing inorganic fibers are made of a mineral material that includes at least any one member of a second mineral material component group including silicon dioxide ($SiO_2$), aluminum oxide ($Al_2O_3$), and iron oxide ($Fe_2O_3$). The reinforcing inorganic fibers have a length of at least 10 mm and are oriented in parallel to each other in at least one direction.

The present fiber composite materials are produced by orienting the inorganic mineral fibers having a length of at least 10 mm in at least one direction so that the mineral fibers are arranged in parallel to one another, then heating the mineral fibers to at least 200° C., thereby bonding the fibers to one another to form a fiber film and embedding or enclosing said fiber film in the metal matrix which may be formed by sheet metal layers. A plurality of sheet metal layers may be used and bonded to each other by a plurality of fiber films in a laminated structure.

The heating to at least 200° C. is preferably, but not necessarily combined with a pressurization at a pressure of at least 10 MPa. Moreover, the heating, bonding and embedding or inclusion is preferably performed in a vacuum chamber and still more preferably in an inert gas atmosphere, for example in an autoclave or the like. A plurality of mineral fiber films and sheet metal layers may be bonded to one another in a rolling operation to form the fiber-composite laminated sheet material. In all instances the sheet metals are made of aluminum, or aluminum alloys, or magnesium, or magnesium alloys, or titanium or titanium alloys or combinations thereof. The aluminum, or the magnesium or the titanium forms a main or dominant component in the respective alloy. The inorganic reinforcing mineral fibers are preferably made of any one or more of the following mineral materials, namely basalt, granite, diabase, amphibolite, diorite, trachyte, porphyry, and obsidian.

The advantage of these mineral materials is seen in their substantial modulus of elasticity within the range of 90 to 120 GPa. Another advantage of these materials is seen in their substantial working temperature range of −260° C. to +640° C. These materials also have good working characteristics when substantial temperature changes or variations occur. Additionally, these materials have a good corrosion resistance. Moreover, the just outlined good characteristics of these inorganic mineral materials remain constant even in response to vibrations.

BRIEF DESCRIPTION OF THE DRAWINGS

In order that the invention may be clearly understood, it will now be described in connection with example embodiments thereof, with reference to the accompanying drawings, wherein.

DETAILED DESCRIPTION OF A PREFERRED EXAMPLE EMBODIMENT AND OF THE BEST MODE OF THE INVENTION

Figure 1:
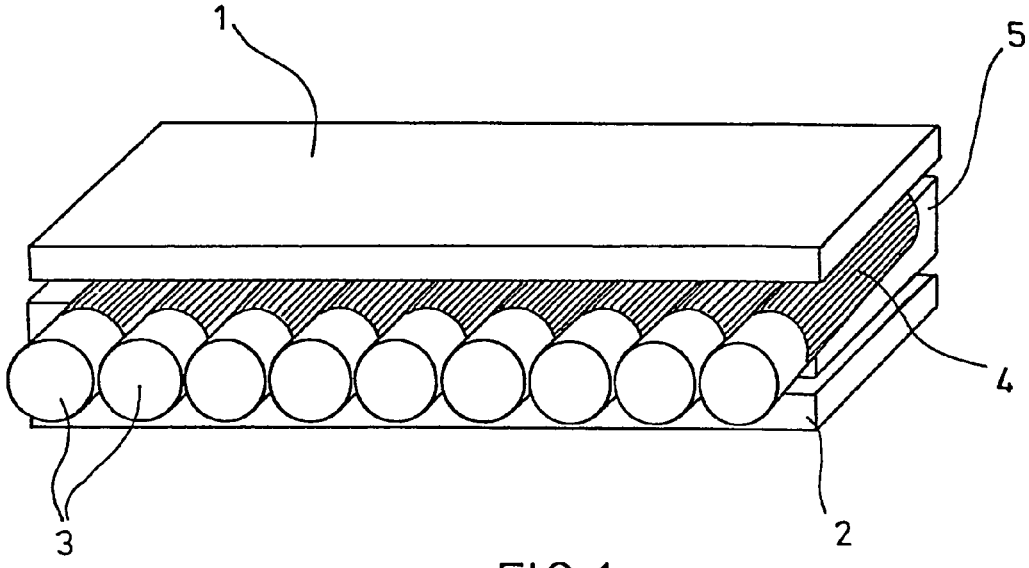
FIG. 1 is a perspective view of a fiber composite material according to the invention prior to compression.

FIG. 1 shows an embodiment of a fiber-reinforced composite material according to the invention including a top cover metal sheet 1 and a bottom cover metal sheet 2 with inorganic mineral fibers 3 sandwiched between the metal cover sheets 1 and 2 which after bonding form the metal matrix. The fibers 3 have a length of at least 10 mm and a coating 4 of particles that adhesively bond the fibers 3 to each other to form a fiber film 5 which in turn bonds the metal layers or cover sheets 1 and 2 to each other. These metal sheets are made, for example, of an aluminum alloy of the DIN standard series 5XXX which defines an aluminum magnesium alloy $AlMg_2$ which forms the metal matrix for the fibers 3.

In another embodiment the matrix material formed by the cover sheets may be made of aluminum copper alloys such as the AA 2024 type or of aluminum zinc alloys such as the AA 7075 type. An aluminum lithium alloy with a lithium content within the range of 0.5 to 3.0% by weight, titanium alloys as well as copper or copper alloys and magnesium alloys are also suitable to form the metal matrix for the present purposes.

The long fibers 3 made of a basaltic material as set forth in the above listing, preferably have a composition as set forth in the following Table of:

Mineral Fiber Example Materials

| Component | Weight % | Preferred wt. % | Remainder |
|---|---|---|---|
| $SiO_2$ | 35 to 55 | 47 to 50 | mineral |
| $Al_2O_3$ | 10 to 25 | 15 to 18 | material |
| $Fe_2O_3$ FeO | 7 to 20 | 11 to 14 | from the |
| MgO | 3 to 12 | 5 to 7 | above |

-continued

| Component | Weight % | Preferred wt. % | Remainder |
|---|---|---|---|
| CaO | 5 to 20 | 6 to 12 | listing |
| $TiO_2$ | 0 to 5 | 1 to 2 | (any |
| N2O | 0 to 5 | 2 to 3 | one |
| K20 | 0 to 10 | 2 to 7 | or more) |

As shown in FIGS. 1, 2, 3, 4 and 5 the long fibers 3 which have a length of at least 10 mm, are oriented in parallel to one another thereby extending in at least one direction. However, the fibers may also be arranged in several plies, whereby the fiber orientation is still in parallel in each ply, but in the manner of a fabric so that the fibers in one ply extend in one direction while the fibers in another ply extend in a crosswise direction as, for example shown in FIGS. 6 and 7. Relative to the total volume of a composite sheet material according to the invention, the fibers occupy preferably a volume portion within the range of about 10 to about 70%. The matrix metal will then occupy a volume within the range of 90 to 30% respectively.

Figure 2:
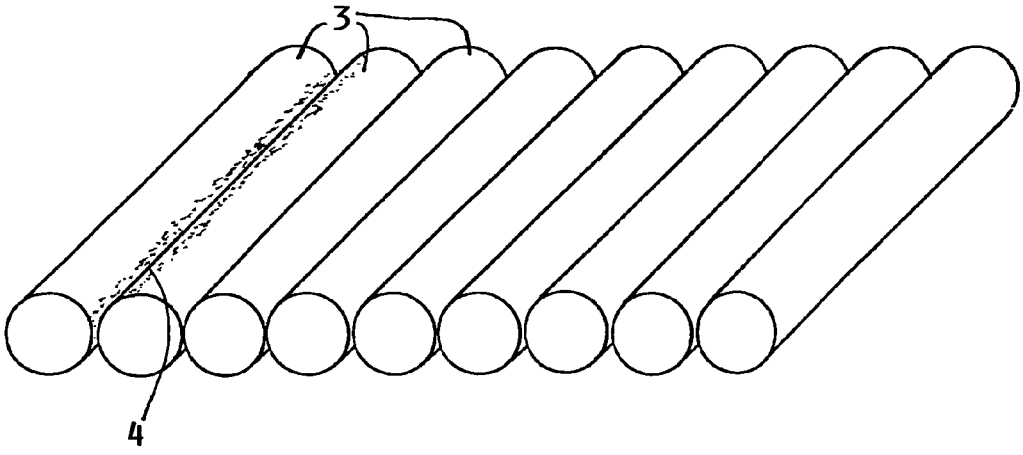
FIG. 2 shows a perspective view of mineral fibers arranged in parallel to one another for bonding to each other.
Figure 3:
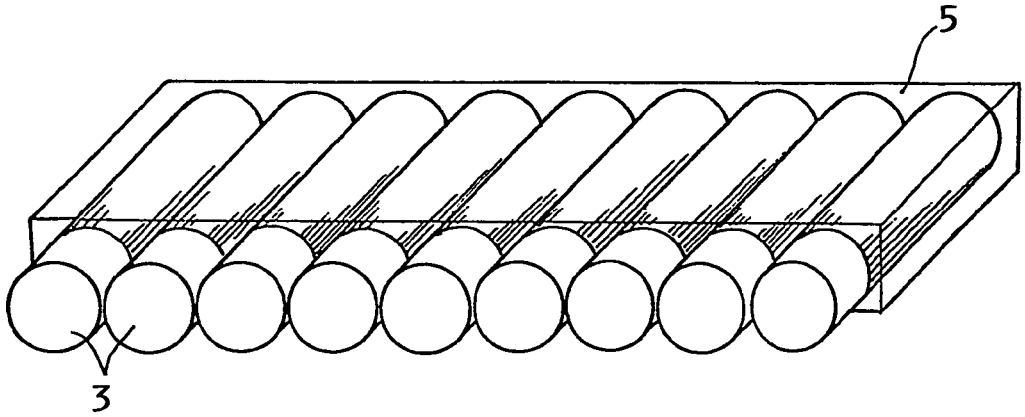
FIG. 3 illustrates the fibers of FIG. 2 after compression which produces a film of fibers.

The fibers 3 according to the invention are provided with the particle coating 4 in a thermal operation to enhance the bonding of the fibers to each other as shown in FIG. 2. The coating particles are made of aluminum, magnesium, titanium, or alloys of these metals. The alloys contain the respective metal as a predominant or main component. These fibers as used according to the invention have elongation rupture characteristics that are within the range of 2 to 5% of a standardized length. After aligning the fibers in parallel to one another in at least one direction as shown in FIG. 2, the fibers 3 are all consolidated to form the film or ply 5 of fibers as shown in FIG. 3. The bonding is performed at temperatures in excess of 200° C. and at a pressure of at least, preferably exceeding 10 MPa. Preferably the bonding is performed in a vacuum chamber such as an autoclave containing an inert gas atmosphere.

Figure 4:
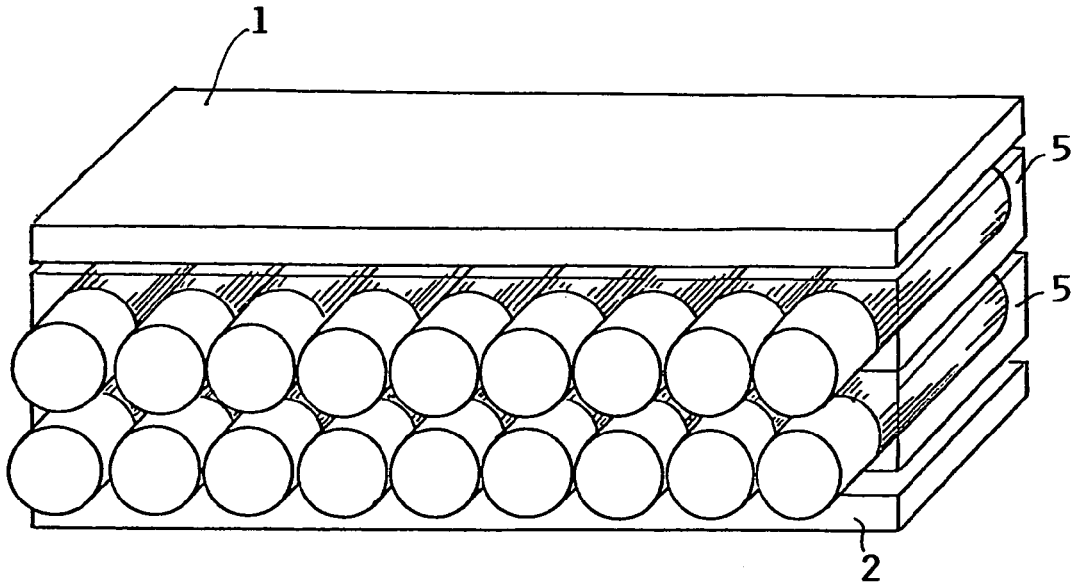
FIG. 4 shows a perspective view of two fiber films sandwiched between two outer sheet metal layers, prior to a rolling operation.
Figure 5:
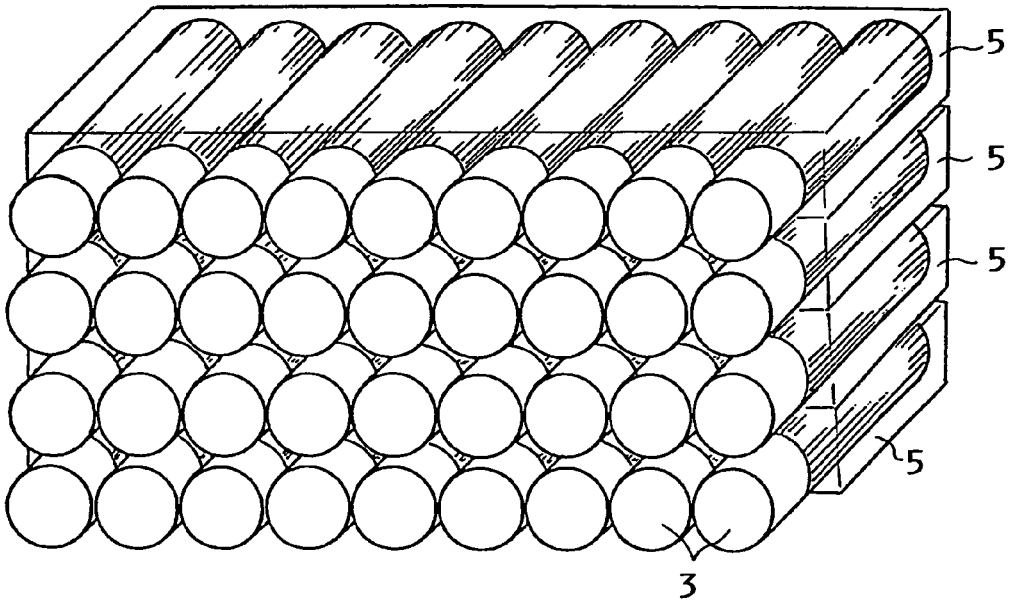
FIG. 5 shows a perspective view of four fiber films, whereby in each film the fibers are oriented in parallel to each other and in parallel to all the other fibers in the other fiber films and prior to the application of sheet metal cover layers for example by a compression or rolling operation.

As shown in FIG. 4 two fiber films 5 are sandwiched between two sheet metal cover layers 1 and 2. These cover layers are made of the metals listed above. The respective alloys contain the metal as a predominant or main proportion. To form a sandwich or laminate, the bonding inorganic mineral layers and the metal layers forming the matrix are exposed to the above mentioned pressure for example in a rolling operation, whereby the gaps between the plies shown in the drawings disappear.

The sheet metal layers 1, 1' and 2, 2' preferably have a thickness in the range of 0.01 mm to 3.0 mm.

FIG. 4 shows an embodiment of four fiber films 5 in which all the fibers in each film are oriented in parallel to each other in the same direction in each film. These films after formation are then sandwiched between metal cover layers.

Figure 6:
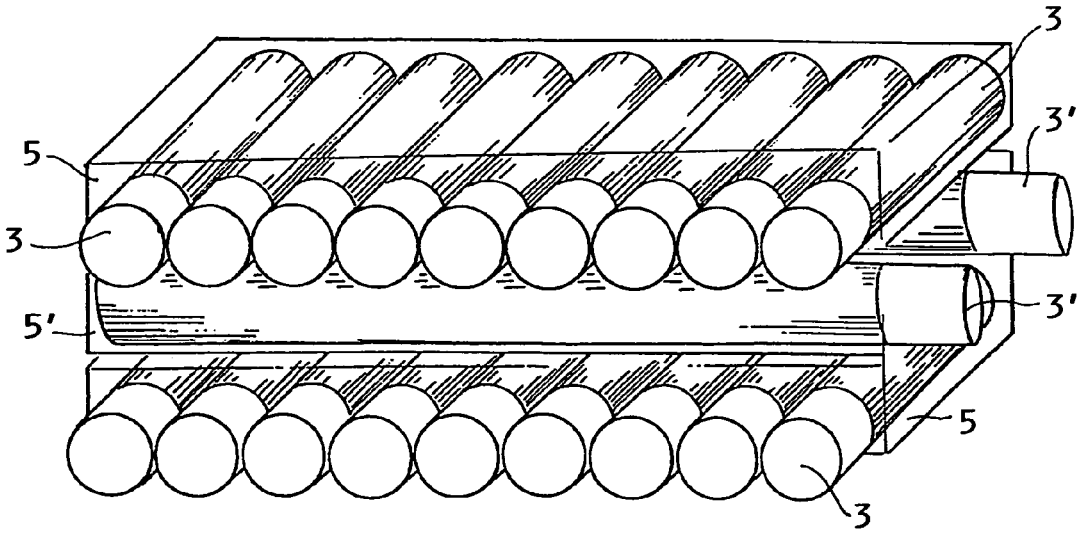
FIG. 6 illustrates two outer fiber films in which the fibers are oriented in parallel to each other in the same direction and an intermediate fiber film in which the fibers are also oriented in parallel to one another, but at a right angle to the fibers in the two outer fiber films and prior to the application of outer sheet metal layers.

As shown in FIG. 6, the fibers 3 of the upper and lower films or plies 5 are arranged in parallel to one another and in the same direction while the fibers 3' in the intermediate ply 5' are oriented at right angles to the orientation direction of the fibers in the plies or films 5 in the upper and lower plies.

Figure 7:
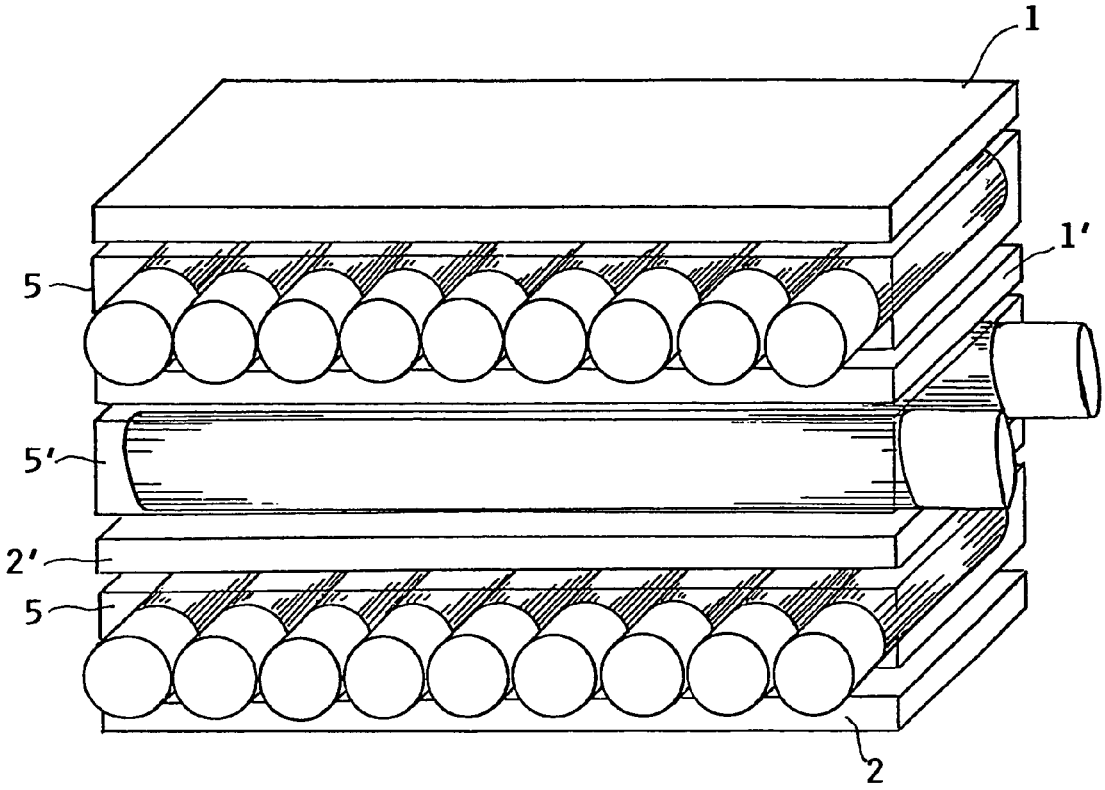
FIG. 7 illustrates a perspective view of a fiber composite material with three fiber films, two outer metal layers, and two inner metal layers forming a laminate.

FIG. 7 illustrates an embodiment with three plies of fibers, whereby the outer plies 5 have the fibers oriented in the same direction while the fibers in the intermediate ply 5' are oriented at right angles to the fibers in the outer plies 5 as shown in FIG. 6. Additionally, each ply is sandwiched between two metal plies 1 and 1'; 1', 2', and 2 and 2'. Thus, a total of four metal plies are used namely 1, 1', 2, 2'. The metal plies or layers preferably have a thickness within the range of 0.01 mm to 3.0 mm as mentioned above.

Once the plies are arranged in a laminate, the fiber composite material is subjected to pressure preferably in a rolling operation. The resulting composite material is particular suitable in aircraft construction, more specifically, for aircraft bodies, whereby at least a portion of the body can be made of the present composite materials forming the aircraft skin and/or reinforcements of the aircraft skin.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A fiber composite sheet material comprising plural sheet metal layers and at least one fiber reinforced film respectively laminated between and bonded to two of said sheet metal layers, wherein:

each one of said sheet metal layers respectively comprises at least one metal selected from a group of aluminum, aluminum alloys, magnesium, magnesium alloys, titanium, titanium alloys, copper and copper alloys, said at least one fiber reinforced film respectively comprises reinforcing fibers having a fiber length of at least 10 mm and extending parallel to each other in a respective one of said at least one fiber reinforced film, said reinforcing fibers each respectively have a fiber core with a composition comprising at least one inorganic mineral material selected from a group of silicon dioxide ($SiO_2$), aluminum oxide ($Al_2O_2$) and iron oxide ($Fe_2O_2$, FeO), and on said fiber core a bonding coating of metal particles comprising at least one metal selected from a group of aluminum, aluminum alloys, magnesium, magnesium alloys, titanium and titanium alloys, and said bonding coating bonds said reinforcing fibers to each other in said respective fiber reinforced film and bonds said respective fiber reinforced film to at least one adjoining one of said sheet metal layers.

2. The fiber composite sheet material according to claim 1, wherein exactly one of said fiber reinforced film is respectively arranged between and bonded to two of said sheet metal layers.

3. The fiber composite sheet material according to claim 1, wherein at least two of said fiber reinforced film are respectively arranged between and bonded to two of said sheet metal layers.

4. The fiber composite sheet material according to claim 1, wherein said fiber core comprises said silicon dioxide within a range of 35 to 55% by weight of said composition of said fiber core.

5. The fiber composite sheet material according to claim 1, wherein said fiber core comprises said aluminum oxide within a range of 10 to 25% by weight of said composition of said fiber core.

6. The fiber composite sheet material according to claim 1, wherein said fiber core comprises said iron oxide within a range of 7 to 20% by weight of said composition of said fiber core.

7. The fiber composite sheet material according to claim 1, wherein said composition of said fiber core of at least a respective one of said reinforcing fibers further comprises at least one of titanium oxide ($TiO_2$), magnesium oxide (MgO), calcium oxide (CaO), nitrous oxide ($N_2O$) and potassium oxide, in addition to said at least one inorganic mineral material.

8. The fiber composite sheet material according to claim 7, wherein said fiber core comprises said titanium oxide within a range of more than 0% to 5% by weight of said composition of said fiber core.

9. The fiber composite sheet material according to claim 7, wherein said fiber core comprises said magnesium oxide within a range of 3 to 10% by weight of said composition of said fiber core.

10. The fiber composite sheet material according to claim 7, wherein said fiber core comprises said calcium oxide within a range of 5 to 20% by weight of said composition of said fiber core.

11. The fiber composite sheet material according to claim 7, wherein said fiber core comprises said nitrous oxide within a range of more than 0% to 5% by weight of said composition of said fiber core.

12. The fiber composite sheet material according to claim 7, wherein said fiber core comprises said potassium oxide within a range of more than 0% to 10% by weight of said composition of said fiber core.

13. The fiber composite sheet material according to claim 1, wherein said sheet metal layers occupy 30 to 90% by volume of said fiber composite sheet material, and wherein said at least one fiber reinforced film occupies 70 to 10% by volume of said fiber composite sheet material.

14. The fiber composite sheet material according to claim 1, wherein said sheet metal layers each respectively have a thickness within a range of 0.01 to 3.0 mm.

15. The fiber composite sheet material according to claim 1, wherein said at least one fiber reinforced film comprises a plurality of said fiber reinforced films, wherein said reinforcing fibers extend parallel to each other respectively in each said fiber reinforced film and in different directional orientations in neighboring ones of said fiber reinforced films.

16. The fiber composite sheet material according to claim 1, wherein said fiber core comprises at least one of basalt, granite, diabase, amphibolite, diorite, trachyte, porphyry and obsidian, having said composition.

17. An aircraft body comprising a fiber composite sheet material according to claim 1 in at least one portion of said aircraft body.

18. The aircraft body according to claim 17, wherein said fiber composite sheet material is a reinforcement of said at least one portion of said aircraft body.

19. A method of manufacturing the fiber composite sheet material according to claim 1, said method comprising the following steps:

a) orienting said fiber cores of said reinforcing fibers parallel to each other to provide oriented fiber cores, b) coating said oriented fiber cores with said metal particles to form oriented and coated fibers in a respective said fiber reinforced film, c) laminating said respective fiber reinforced film between said sheet metal layers to form a laminate, and d) heating said laminate to a temperature of at least 200° C. thereby bonding said fibers to each other and to said sheet metal layers.

20. The method according to claim 19, wherein said step d) further comprises combining said heating with pressurizing at a pressure of at least 10 MPa (megapascal).

21. The method according to claim 19, further comprising performing said laminating, said heating and said bonding in a vacuum chamber.

22. The method according to claim 19, further comprising performing said laminating, said heating and said bonding in an inert gas atmosphere.

23. The method according to claim 19, further comprising laminating a plurality of said fiber reinforced film and said sheet metal layers to one another in a rolling operation to form said laminate in said step c).

* * * * *

UNITED STATES PATENT AND TRADEMARK OFFICE

CERTIFICATE OF CORRECTION

PATENT NO. : 7,794,851 B2
APPLICATION NO. : 11/018583
DATED : September 14, 2010
INVENTOR(S) : Alexei Vichniakov It is certified that error appears in the above-identified patent and that said Letters Patent is hereby corrected as shown below:

On the Title page,
Item [75], Inventor, after "Vichniakov", replace "Buzbehude" to --Buxtehude--;

Column 6,
Line 32, after "aluminum oxide", replace "($Al_2O_2$)" to --($Al_2O_3$)--;
after "iron oxide", replace "($Fe_2O_2$," to --($Fe_2O_3$,--.

Signed and Sealed this
Thirteenth Day of March, 2012

David J. Kappos

David J. Kappos
*Director of the United States Patent and Trademark Office*